US006418950B1

(12) United States Patent
Tseng

(10) Patent No.: US 6,418,950 B1
(45) **Date of Patent: *Jul. 16, 2002**

(54) UMBRELLA HAVING A ROTATION PREVENTION MECHANISM

(75) Inventor: Cheng Yuan Tseng, Taichung (TW)

(73) Assignee: Windbrella products Corp., New York ( * ) Notice: Subject to any disclaimer, the term of this patent is extended or adjusted under 35 U.S.C. 154(b) by 0 days.

This patent is subject to a terminal disclaimer.

(21) Appl. No.: 09/735,867

(22) Filed: Dec. 14, 2000

(51) Int. Cl.[7] ..... A45B 25/28

(52) U.S. Cl. ..... 135/28; 135/39; 135/40; 135/20.3

(58) Field of Search ..... 135/28, 37, 38, 135/39, 40, 41, 25.4, 25.33, 20.3

(56) References Cited

U.S. PATENT DOCUMENTS 3,156,249 A * 11/1964 Biderman ..... 135/39 X
3,658,076 A 4/1972 Yasuda ..... 135/22
5,184,639 A * 2/1993 Lee ..... 135/28
5,287,869 A * 2/1994 Wu ..... 135/40
5,398,709 A * 3/1995 Lee ..... 135/28
6,006,771 A * 12/1999 Wu ..... 135/41
6,024,108 A * 2/2000 Kuo et al. ..... 135/24
6,216,712 B1 * 4/2001 Lin et al. ..... 135/28 X
6,247,483 B1 * 6/2001 Tung ..... 135/38

* cited by examiner

*Primary Examiner*—Carl D. Friedman
*Assistant Examiner*—Winnie Yip
(74) *Attorney, Agent, or Firm*—Charles E. Baxley

(57) ABSTRACT

An umbrella includes a tube having a whale bone device, a barrel slidably engaged on the tube and coupled to the whale bone device. Two spring-biased catches are received in the tube and selectively engaged into the barrel to lock the barrel to the tube and to prevent the barrel from rotating relative to the tube. A latch is slidably received in the barrel for selectively disengaging the catch from the barrel and is received in the barrel which is moved away from the handle when the whale bone device is opened, such that the latch will not be actuated inadvertently.

3 Claims, 3 Drawing Sheets

UMBRELLA HAVING A ROTATION PREVENTION MECHANISM

BACKGROUND OF THE INVENTION

1. Field of the Invention

The present invention relates to an umbrella, and more particularly to an umbrella having a rotation prevention mechanism.

2. Description of the Prior Art

U.S. Pat. No. 3,658,076 to Yasuda discloses a typical umbrella including two or more spring members that are required to be engaged in the middle or central tube for controlling the operation of the umbrella, and including a latch or a lock member required to be disposed in the bottom or lower portion of the tube for latching to a slide or a sliding ring and for locking the umbrella at a folded configuration. The umbrella includes a complicated configuration that may not be easily manufactured and assembled. In addition, when the umbrella is opened at a working position, the latch or the lock member that is disposed in the bottom or lower portion of the tube will be exposed or extended outward of the tube and will be depressed by the users inadvertently. Relatively, the users, such as the hands of the users that hold the handle of the umbrella, may also be hurt by the latch or the lock member that is exposed or extended outward of the tube. In addition, the sliding ring may be rotated relative to the tube, such that the whale bone device provided on top of the tube may also rotated relative to the tube.

The present invention has arisen to mitigate and/or obviate the afore-described disadvantages of the conventional umbrellas.

SUMMARY OF THE INVENTION

The primary objective of the present invention is to provide an umbrella including a rotation prevention mechanism for preventing the whale bone and the stave device from rotating relative to the central tube of the umbrella.

The other objective of the present invention is to provide an umbrella including a latch that will be slided upward of the tube and will not be exposed or extended outward of the lower portion of the tube.

In accordance with one aspect of the invention, there is provided an umbrella comprising a tube including an upper portion and a lower portion having a handle provided thereon, a whale bone device pivotally secured to the upper portion of the tube and movable between an open position and a folded position, a barrel slidably engaged on the tube, the barrel including a channel formed therein and including a cavity formed therein and communicating with the channel of the barrel, means for coupling the barrel to the whale bone device, two spring-biased catches received in the upper portion and the lower portion of the tube respectively and selectively engageable into the cavity of the barrel when the cavity of the barrel is aligned with either of the catches, and a latch slidably received in the barrel, the latch including an actuator slidably received in the cavity of the barrel for selectively disengaging the catches from the barrel to release the barrel from the tube. The cavity of the barrel has a cross section corresponding to that of the catches for allowing the catches to be snugly fitted in the cavity of the barrel and for preventing the barrel from rotating relative to the tube.

The latch is ring-shaped is slidably received in the channel of the barrel for slidably receiving the tube therein, and includes a knob extendible outward of the barrel. The barrel includes a depression formed therein for receiving the knob.

The cavity of the barrel includes a width smaller than that of the channel of the barrel for snugly receiving the catches and for preventing the barrel from rotating relative to the tube.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
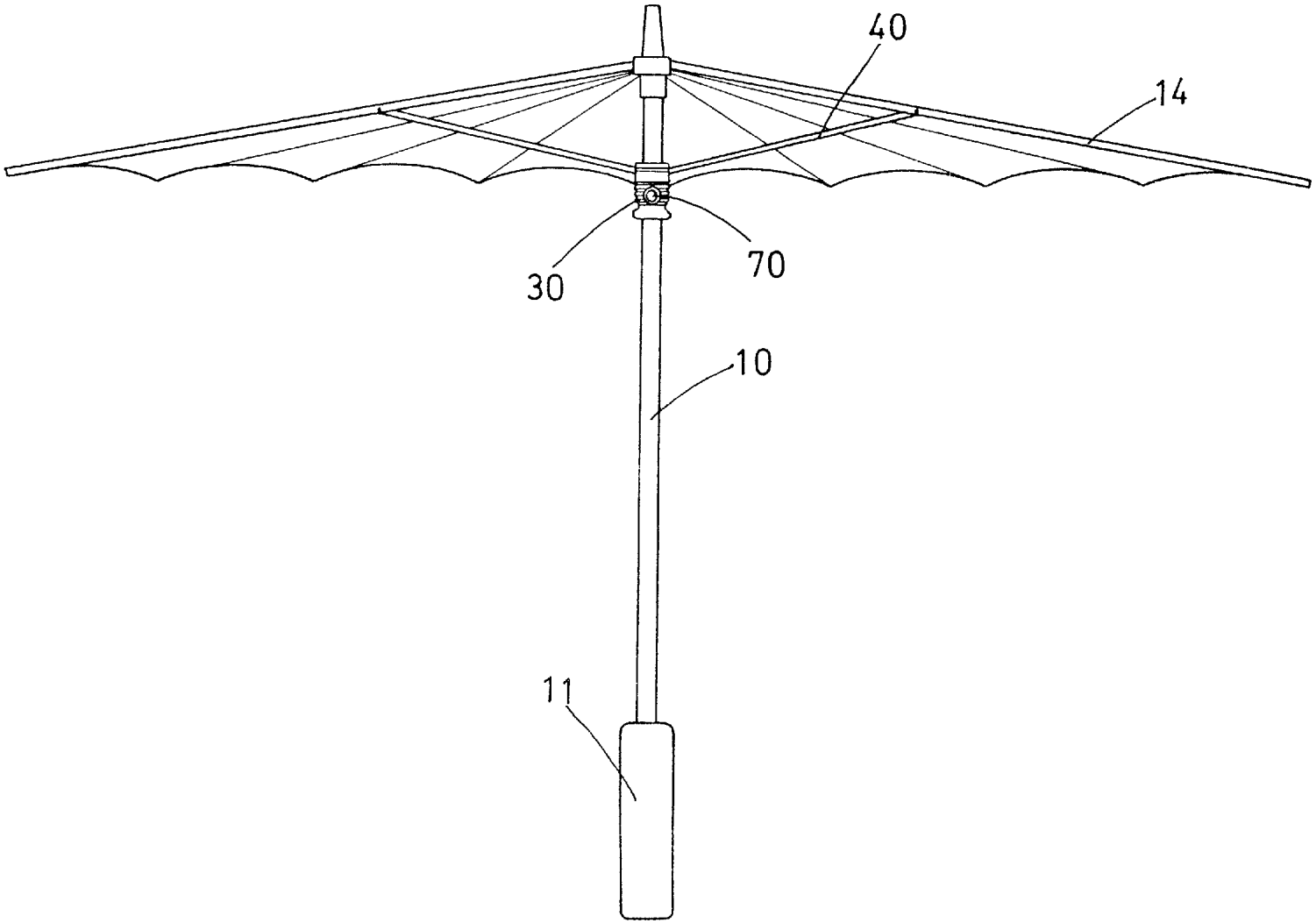
FIG. 1 is a plane schematic view of an umbrella in accordance with the present invention.
Figure 2:
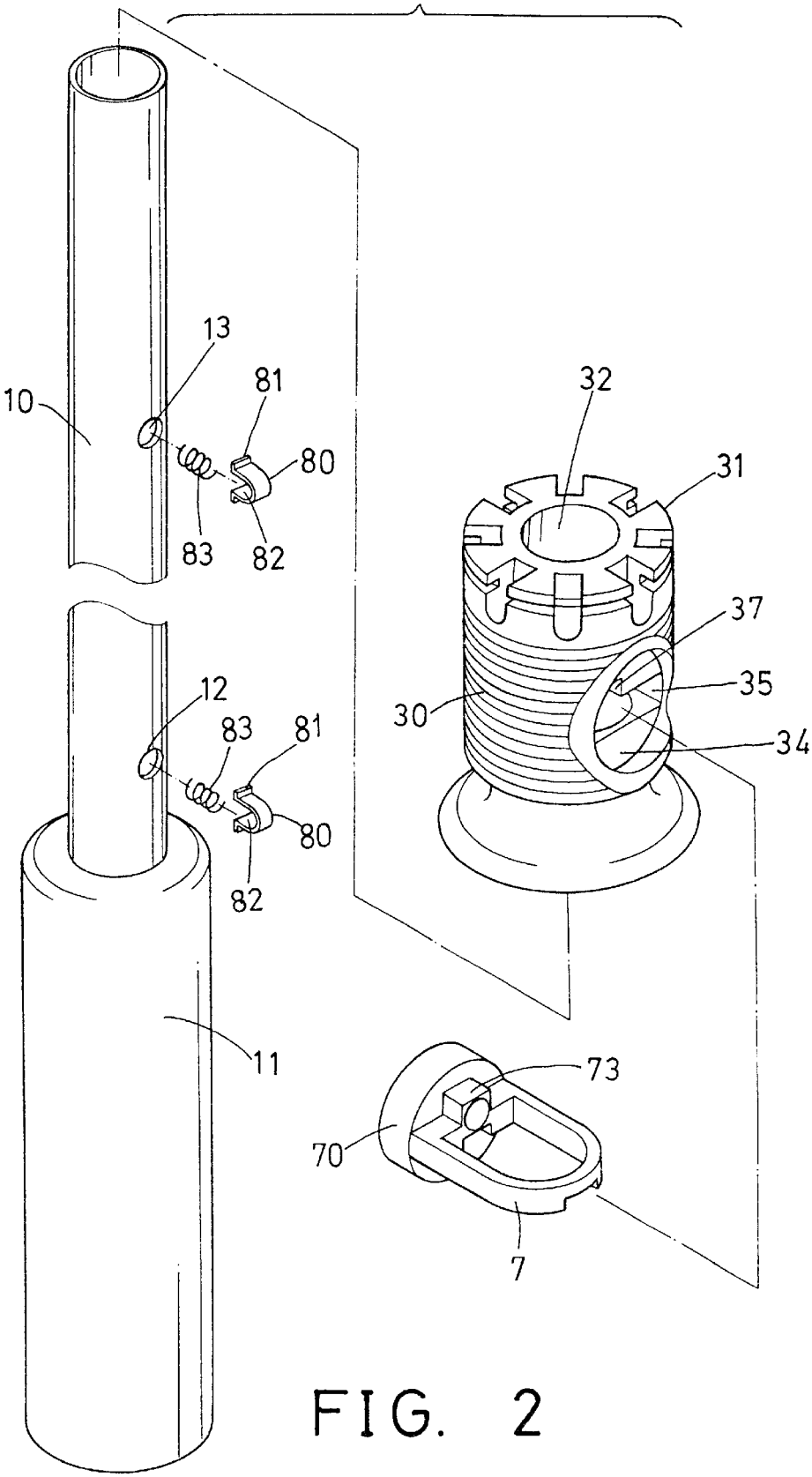
FIG. 2 is a partial exploded view of the umbrella.

Referring to the drawings, and initially to FIGS. 1–4, an umbrella in accordance with the present invention comprises a tube 10 including a handle 11 provided and disposed on the bottom portion thereof, and including an upper portion and a lower portion each having an orifice 13, 12 formed therein. A typical whale bone device 14 is pivotally attached to the upper portion of the tube 10 and is openable to an open or working position as shown in FIG. 1, and is foldable to a folded or storing position. A barrel 30 is slidably engaged on the tube 10 and disposed above the handle 11. A number of typical staves or a stave device 40 is pivotally coupled between the whale bone device 14 and the barrel 30. The barrel 30 preferably includes a ring 31 provided on top thereof for pivotally coupling to the stave device 40. The barrel 30 includes a bore 32 formed therein for slidably receiving the tube 10. The above described structure is typical and will not be described in further details.

Two catches 80 and two springs 83 are received in the orifices 12, 13 of the tube 10 respectively. The catches 80 each includes a recess 82 formed therein for receiving the spring 83 and each includes one or more flanges 81 extended therefrom for engaging with the tube 10. (FIG. 3) and for preventing the catches 80 from being disengaged from the tube 10. The catches 80 thus may be forced to move inward and outward of the tube 10. The barrel 30 includes a channel 35 laterally formed therein and communicating with or intersecting with the bore 32 of the barrel 30, and includes a depression 34 formed in the outer portion thereof and communicating with the channel 35 of the barrel 30, and includes a cavity 37 formed therein and communicating with the bore 32 and the channel 35 of the barrel 30. The catches 80 may be biased inward of the channel 35 of the barrel 30 to lock the barrel 30 to the tube 10 (FIGS. 3 and 4) when the barrel 30 is moved to be aligned with either of the orifices 13, 12 formed in either the upper portion or the lower portion of the tube 10. The cavity 37 is preferably formed above the channel 35 of the barrel 30 and has a cross sectional area or a width less than that of the channel 35 of the barrel 30 and about equal to that of the catches 80, or has a cross section corresponding to that of the catches 80, for allowing the catches 80 to be snugly fitted or engaged in the cavity 37 of the barrel 30 and for preventing the barrel 30 from being rotated relative to the tube 10.

Figure 3:
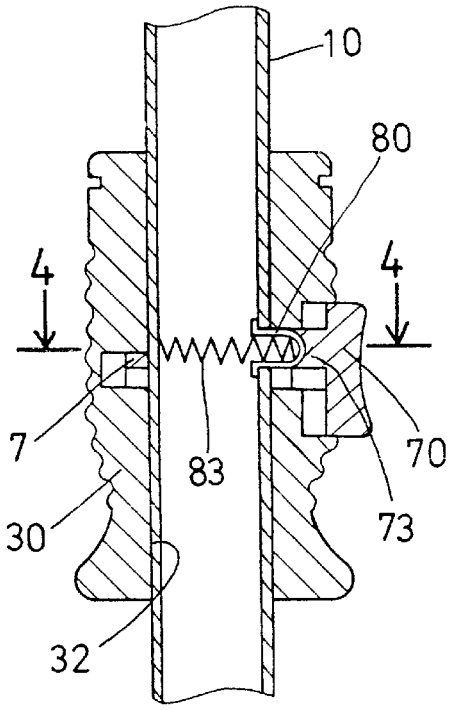
FIG. 3 is a partial cross sectional view taken along lines 3—3 of FIG. 4.

A latch 7 which is ring-shaped is slidably received in the channel 35 of the barrel 30 and is engaged on the tube 10. Relatively, the tube 10 is slidably received in the ring-shaped latch 7 (FIGS. 3–6). The latch 7 includes a knob 70 slidably received in the depression 34 of the barrel 30 and extendible outward of the depression 34 of the barrel 30. The latch 7 includes an actuator 73 extended therefrom, and/or extended from the knob 70, and slidably engaged or received in the cavity 37 of the barrel 30, for engaging with the catches 80 (FIGS. 3, 5). The springs 83 may bias the catches 80 to engage into the channel 35 of the barrel 30 and to lock the barrel 30 to the tube 10 (FIGS. 3, 4); and may also bias the knob 70 outward of the depression 34 of the barrel 30. The catch 80 may be forced or moved inward of the tube 10 by the actuator 73 of the latch 7 and may be disengaged from the barrel 30, such that the barrel 30 may be released from the tube 10 when the knob 70 is depressed inward of the depression 34 of the barrel 30 against the spring 83.

Figure 4:
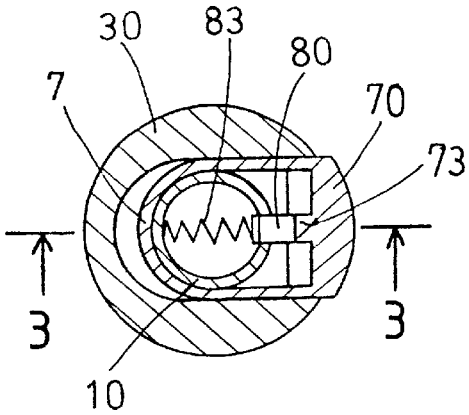
FIG. 4 is a partial cross sectional view taken along lines 4—4 of FIG. 3.
Figure 6:
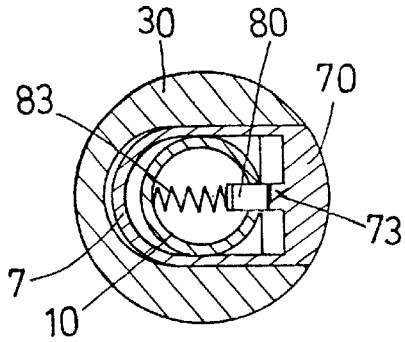
FIGS. 5 and 6 are partial cross sectional views similar to FIGS. 3 and 4 respectively, illustrating the operation of the umbrella.
Figure 5:
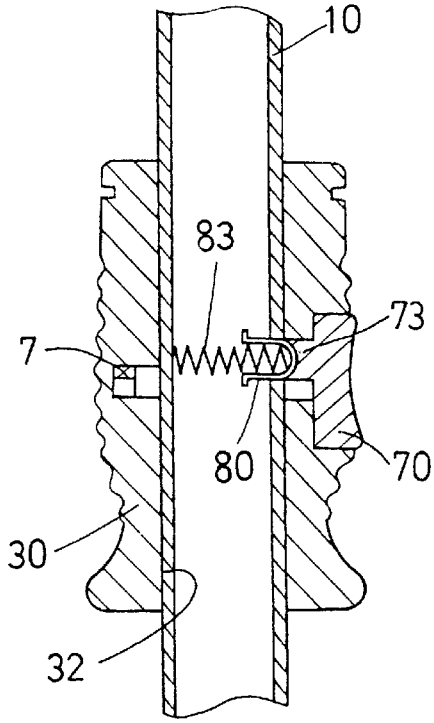

In operation, as shown in FIG. 4, when the barrel 30 is pulled to either the upper or the lower portion of the tube 10 until the catch 80 is biased to engage into the cavity 37 of the barrel 30, the barrel 30 may be latched or locked to the tube 10 by the spring-biased catch 80. When the catch 80 is depressed inward of the tube 10 by the actuator 73 of the latch 7, the barrel 30 will be released from the tube 10 and may be moved along the tube 10 to any suitable position, or until the other catch 80 is engaged into the cavity 37 of the barrel 30 and to lock the barrel 30 to the tube 10 again.

It is to be noted that the knob 70 and/or the actuator 73 and/or the latch 7 is received in the barrel 30 and may be moved, together with the barrel 30, upward toward the upper portion of the tube 10, and thus may be moved away from the handle 11 when the umbrella is opened. The latch 7 or the knob 70 of the latch 7 will not be depressed by the users inadvertently when the barrel 30 is moved to the upper portion of the tube 10. The barrel 30 of the umbrella includes a cavity 37 formed therein, in addition to the channel 35 of the barrel 30, and communicating with the channel 35 of the barrel 30, for receiving the actuator 73 of the latch 7 and for forming a rotation prevention mechanism to prevent the barrel 30 and thus the whale bone device 14 from being rotated relative to the tube 10. The cavity 37 of the barrel 30 has a cross sectional area or a width less than that of the channel 35 of the barrel 30 and about equal to that of the catches 80, for allowing the catches 80 to be snugly fitted or engaged in the cavity 37 of the barrel 30 and for preventing the barrel 30 from being rotated relative to the tube 10.

Accordingly, the umbrella in accordance with the present invention includes a rotation prevention mechanism for preventing the whale bone device and the stave device of the umbrella from rotating relative to the tube, and includes a latch that will be slided upward of the tube and will not be exposed or extended outward of the lower portion of the tube.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An umbrella comprising:

a tube including an upper portion and a lower portion having a handle provided thereon.

a whale bone device pivotally secured to said upper portion of said tube and movable between an open position and a folded position, a barrel slidably engaged on said tube, said barrel including a channel formed therein and including a cavity formed therein and communicating with said channel of said barrel, means for coupling said barrel to said whale bone device, two spring-biased catches received in said upper portion and said lower portion of said tube respectively and selectively engageable into said cavity of said barrel when said cavity of said barrel is aligned with either of said catches, and a latch slidably received in said barrel, said latch including an actuator slidably received in said cavity of said barrel for selectively disengaging said catches from said barrel to release said barrel from said tube, said cavity of said barrel having a cross section corresponding to that of said catches for allowing said catches to be snugly fitted in said cavity of said barrel and for preventing said barrel from rotating relative to said tube, and said latch being ring-shaped and being slidably received in said channel of said barrel for slidably receiving said tube therein, and including a knob extendible outward of said barrel.

2. The umbrella according to claim 1, wherein said barrel includes a depression formed therein for receiving said knob.

3. The umbrella according to claim 1 wherein said cavity of said barrel includes a width smaller than that of said channel of said barrel for snugly receiving said catches.

* * * * *